United States Patent [19]

Kajita et al.

[11] 4,429,523

[45] Feb. 7, 1984

[54] PROCESS FOR MAKING FASCIATED SPUN YARN

[75] Inventors: Koji Kajita, Omihachiman; Takashi Nakayama; Seiichi Yamagata, both of Otsu, all of Japan

[73] Assignee: Toray Industries, Inc., Tokyo, Japan

[21] Appl. No.: 396,063

[22] Filed: Jul. 7, 1982

[30] Foreign Application Priority Data

Jul. 8, 1981 [JP] Japan ..... 56-105707

[51] Int. Cl.[3] ..... D01H 5/28; D02G 3/22

[52] U.S. Cl. ..... 57/328; 57/204; 57/293

[58] Field of Search ..... 57/328–331, 57/393, 394, 204, 205

[56] References Cited

U.S. PATENT DOCUMENTS

| | | | |
|---|---|---|---|
| 3,079,746 | 3/1963 | Field, Jr. | 57/328 |
| 3,487,619 | 1/1970 | Field, Jr. | 57/328 |
| 3,992,865 | 11/1976 | Tuchida et al. | 57/328 |
| 4,003,194 | 1/1977 | Yamagata et al. | 57/328 |
| 4,112,658 | 9/1978 | Morihashi | 57/328 |
| 4,183,202 | 1/1980 | Morihashi | 57/328 |
| 4,351,146 | 9/1982 | Faure et al. | 57/293 X |

*Primary Examiner*—John Petrakes

*Attorney, Agent, or Firm*—Austin R. Miller

[57] ABSTRACT

A process for making a fasciated spun yarn by drafting and pneumatically false twisting a bundle of staple fibers is disclosed. In the method, the width W (mm) of a bundle of fibers measured just upstream of the nip point of a pair of second rollers of a drafting zone and a yarn count N (Nm) of the spun yarn are set to satisfy the following equation:

$$60/\sqrt{N} \leqq W \leqq 170/\sqrt{N}$$

and the overfeed ratio of the bundle of fibers during the false twisting operation is 5% at most. The fasciated spun yarn made by this process has a straight shape, resembles a ring-spun yarn and has sufficiently stable strength.

6 Claims, 18 Drawing Figures

PROCESS FOR MAKING FASCIATED SPUN YARN

BACKGROUND OF THE INVENTION

1. Field of the Invention

The present invention relates to a process for making a fasciated spun yarn.

A fasciated yarn spinning process is a process having high production efficiency in which the fasciated spun yarn, having fibers wrapping around and fasciated with core fibers composed of substantially untwisted staple fibers, is made by a single step of false twisting a bundle of fibers composed of drafted staple fibers under overfeed conditions.

2. Description of the Prior Art

In the fasciated yarn spinning processes of the prior art, if the spinning step is conducted at a low overfeed ratio, untwisted portions having no wrapping fibers are formed making it difficult to produce a practical yarn. It is, therefore, necessary in the prior art processes to have the overfeed ratio exceed at least 5%. When the overfeed ratio is raised, however, problems arise in that the yarn has an uneven appearance and hard feel, characteristics which are far different from those of the usual ring-spun yarn.

Representative of the prior art is a well known process which uses an aspirator, as is disclosed in U.S. Pat. No. 3,079,746. This process is not effective in the stable delivery of fibers because the air flow in the passage becomes a turbulent flow and has high fluctuations.

As another means, there is a pneumatic suction tube which uses a suction air flow so that it allows a yarn to linearly pass therethrough, as has been disclosed in U.S. Pat. No. 4,003,194. This process is excellent in that the air flow is little disturbed to ensure stability in delivery but insufficient floating fibers are generated by merely using a cylindrical tube, tus making it difficult to spin a strong yarn.

According to another process disclosed in U.S. Pat. No. 4,112,658, two false twisting nozzles having opposite false twisting directions are used in series to form surface wrapping fibers. However, this process is not completely satisfactory partly because compressed air consumption is raised by the use of two nozzles and partly because the surface wrapping fibers are tightly wound producing a yarn with a hard hand.

A process relating to the technique which is the most similar to the present invention among the prior art examples thus far described, as has been disclosed in U.S. Pat. No. 4,003,194, will be described in detail in the following by way of example. This process is conducted by drafting fasciated staple fibers and transferring them while being fed to those aprons which can propagate the false twist given downstream thereof to its nip point upstream thereof in their open state, by false twisting fibers present mainly in the middle portion of the aprons thereby generating peripheral fibers, which are free from being restricted at both ends from the false twisting action or in a similar state, around these false-twisted fasciated fibers, and by subsequently wrapping the aforementioned peripheral fibers upon the false-twisted fasciated fibers leaving the false twisting means in a direction opposite to the false twisting direction.

The spun yarn made by the process described above is structured such that the main fibers occupying a major portion of the spun yarn are in a substantially untwisted state and are wrapped by the free fibers (i.e., the peripheral fibers). As a result, the strength and the hand, the extent of binding irregularities, etc. of the spun yarn are highly dependent upon the amount and the state of wrapping of the free fibers.

In this fasciated yarn spinning process, if the spinning step is conducted at a low overfeed ratio, untwisted portions having no wrapping fibers are formed, making it difficult to make a practical yarn. It is, therefore, necessary to have the overfeed ratio exceed at least 5%. When the overfeed ratio is raised, however, problems arise in that the yarn has an uneven appearance and a hard feel, characteristics which are far different from those of the usual ring-spun yarn.

SUMMARY OF THE INVENTION

It is, therefore, an object of the present invention to provide a process for making a fasciated spun yarn, which is free from the aforementioned problems thus far described in the fasciated yarn spinning process, which permits reduction of the overfeed ratio although it is a fasciated yarn spinning process, and which produces a fasciated spun yarn which has a straight shape resembling that of a ring-spun yarn and has sufficiently stable strength.

The fasciated spun yarn making process of the present invention is characterized in that the width of a bundle of fibers measured at a predetermined portion of the drafting zone and the yarn count of the spun yarn are set to fall within a predetermined range, and in that the overfeed ratio of the bundle of fibers during the false twisting operation is set at a low value.

More specifically, a process for making a fasciated spun yarn according to the present invention, wherein a bundle of fibers is drafted in a drafting zone constructed of a pair of back rollers, a pair of second rollers and a pair of front rollers and wherein the bundle of fibers drafted in the drafted zone is twisted and detwisted by false twisting means while being overfed between the front rollers and a pair of delivery rollers, is characterized in that the overfeed ratio is set to be equal to or lower than 5%, and in that the width W (mm) of the bundle of fibers measured just upstream of the nip point of the second rollers and a yarn count N (Nm) of the spun yarn are set to satisfy the following equation:

$$60/\sqrt{N} \leqq W \leqq 170/\sqrt{N}$$

The overfeed ratio is determined by the following equattion, where the feeding speed of the front rollers is designated by $V_f$ and the drawing speed of the delivery rollers is designated by $V_d$:

$$\text{Overfeed ratio} = [(V_f - V_d)/V_d] \times 100.$$

The second rollers are those which are positioned upstream of the front rollers of the roller drafting zone and which substantially regulate the width W of the bundle of fibers before it enters the overfeed zone.

DESCRIPTION OF THE PREFERRED EMBODIMENTS

Figure 1A:
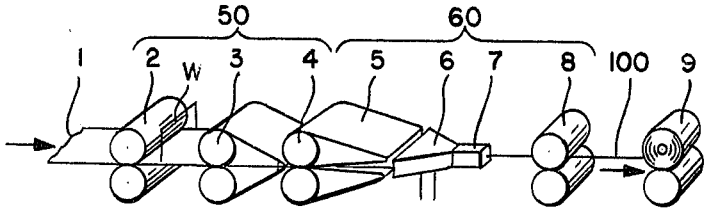
FIGS. 1A, 1B and 1C are perspective views schematically showing embodiments of the production process of the present invention.
Figure 1B:
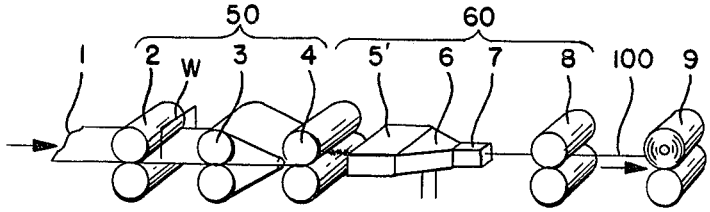
Figure 1C:
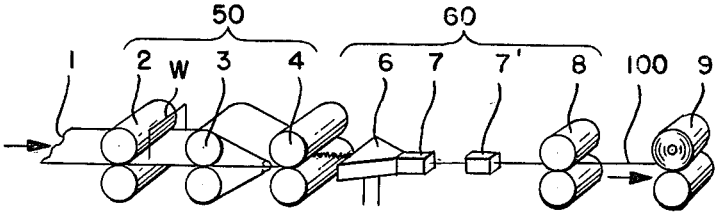

FIGS. 1A to 1C are perspective views schematically showing the production process of the present invention. A pair of rollers 2, a pair of second rollers 3 and a pair of front rollers 4, form a roller drafting zone 50. Conveyor bands 5 run on front rollers 4. The paired upper and lower conveyor bands 5 are arranged to gradually separate from each other such that an open area is formed at the downstream end. Conveyor bands 5 are not indispensable, but may be replaced by another transfer means. For example, as shown in FIG. 1B, the conveyor bands 5 may be replaced by a pneumatic adaptor 5' which has a rectangular shape. Alternatively, as shown in FIG. 1C, no means need be used if false twisting nozzles 7 and 7' are used, because the false twisting nozzle 7 is capable of transferring fibers. Pneumatic duct 6 is also optional. Where false twisting nozzles 7 and 7' are used as shown in FIG. 1C, they are required to have swirling directions opposite to each other.

Moreover, pneumatic duct 6 may be replaced by an aspirator. Still moreover, any fiber transfer means can be used.

Between front rollers 4 and a pair of delivery rollers 8, there is formed an overfeed zone 60, which is equipped with the pneumatic duct 6 and the pneumatic false twisting nozzle 7. Numeral 9 indicates a package of a take-up unit.

In the steps thus far described, a bundle of fibers 1 drafted in the roller drafting zone 50 is false-twisted in the downstream overfeed zone 60 by the pneumatic false twisting nozzle 7. Here, the upstream twist given by the pneumatic false twisting nozzle 7 is propagated to the staple fibers in the middle portion, which belongs to the bundle of fibers 1 being transferred by the conveyor bands 5, but not to the staple fibers on both sides of the same. As a result, there is made a yarn in which the fibers having less twist on both sides are wrapped upon the fasciated center fibers having more twist. If this yarn has the fasciated center fibers detwisted downstream of the pneumatic false twisting nozzle 7, the peripheral free fibers are strongly twisted and fasciated in the detwisting direction upon the fasciated center core fibers, which have been substantially detwisted to an untwisted state, thereby making fasciated spun yarn 100.

According to the present invention, when the fasciated spun yarn thus far described is to be made, the overfeed ratio in the overfeed zone 60 is set to be equal to or lower than 5% so that the fasciated spun yarn 100 has such a straight shape that it resembles ring-spun yarn in appearance. Moreover, the width W (mm) of the bundle of fibers measured just upstream of the nip point of the second rollers of the roller drafting zone 50 and the yarn count N (Nm) of the spun yarn are set to satisfy the following equation:

$$60/\sqrt{N} \leqq W \leqq 170/\sqrt{N}$$

The fiber bundle width (W) defined as above is by far larger than that generally adopted in fasciated spun yarn making methods and in fact the fiber bundle is at least twice as wide as that of previously known processes. As a result, even if the overfeed ratio in the overfeed zone is as low as or lower than 5%, the twisting angle of the staple fibers at both the ends upon the fasciated center fibers is made acute, and the fiber density of the fiber bundle is lowered by setting the fiber bundle width larger than that generally adopted in the prior art. This causes the staple fibers at both the end portions to become free from the twisting operation and to wrap upon the fasciated center fibers. As a result, there are no portions having no wrapping fibers, although the spinning operation is conducted at an overfeed ratio not exceeding 5%, so that a fasciated spun yarn having a stable strength can be made.

Where the spinning operation is to be performed at an overfeed ratio equal to or lower than 5%, the fiber bundle width has to be at least $60/\sqrt{N}$ to make a straight-shaped fasciated spun yarn having a constant strength. The strength constancy is reduced if the fiber bundle width is lower than the value $60/\sqrt{N}$. Preferably, the fiber bundle width is higher than $80/\sqrt{N}$. If the fiber bundle width exceeds $170/\sqrt{N}$, however, the fiber bundle becomes too wide to stabilize the bundling operation of the fibers resulting in a lack of strength in the yarn and deteriorated yarn portions.

Figure 2:
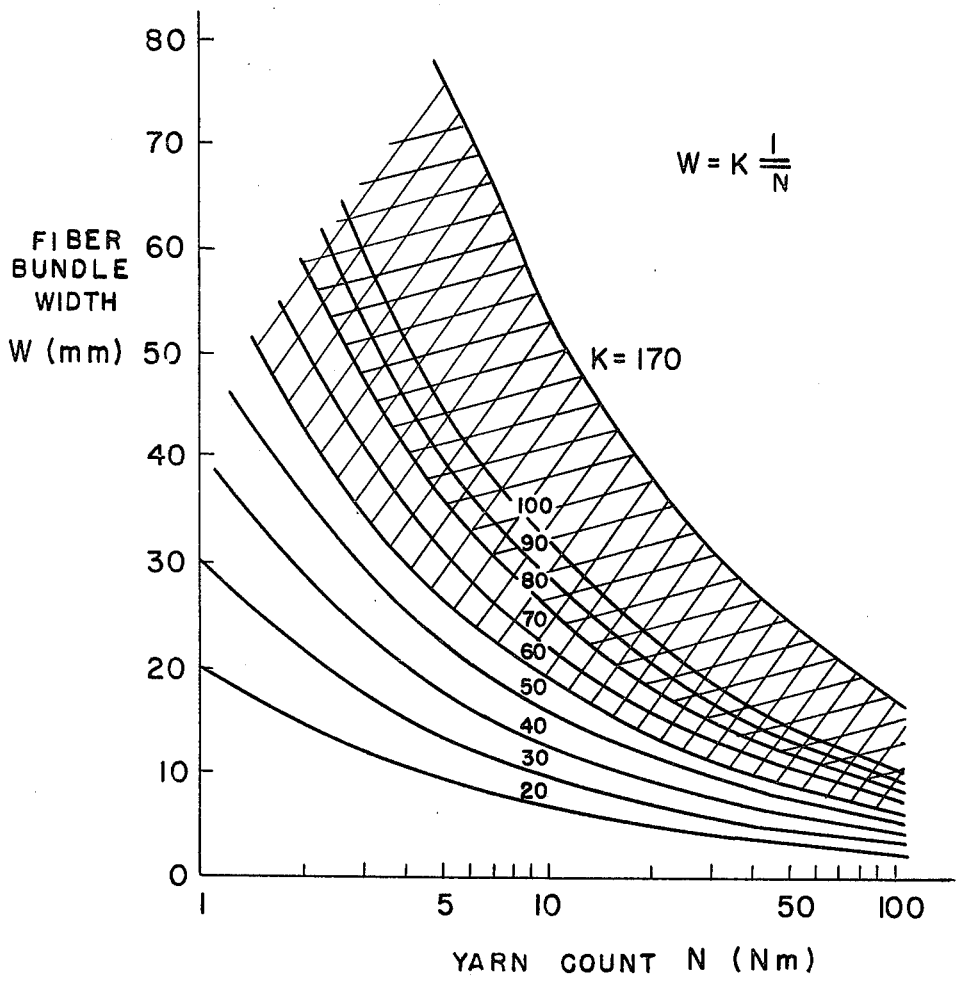
FIG. 2 is a diagram illustrating the relationship between the width W of the bundle of fibers and the yarn count in the process of the present invention for forming a fasciated spun yarn.

FIG. 2 illustrates the relationship between fiber bundle width W and the yarn count N in the process for making a fasciated spun yarn wherein the overfeed ratio set to be equal to or lower than 5% according to the present invention. This invention is practiced within the region which is hatched in FIG. 2. If the relationship is set to fall within the hatched region, it is possible to make a straight-shaped fasciated spun yarn which has a constant strength.

To ensure that the fiber bundle width W is larger than that of the prior art, as has been described in the above, it is most effective to raise the drafting ratio in the roller drafting zone 50 and to enlarge the thickness of the slivers being fed. Where the thickness of the slivers is not sufficient, the strength constancy is reduced because the fiber bundle width may be occasionally reduced by the torsion of the silvers.

As has been described hereinbefore, the process for making a fasciated spun yarn according to the present invention, wherein a bundle of fibers is drafted in a drafting zone formed by the paired back, second and front rollers and wherein the bundle of fibers drafted in the drafted zone is twisted and detwisted by the false twisting means while being overfed between the front rollers and the paired delivery rollers, is characterized in that the overfeed ratio is set to be equal to or lower than 5%, and in that the width W (mm) of the bundle of fibers measured just upstream of the nip point of the second rollers and the yarn count N (Nm) of the spun yarn are set to satisfy the following equation:

$$60/\sqrt{N} \leqq W \leqq 170/\sqrt{N}$$

whereby the strength of the fasciated spun yarn can be kept constant even at a low overfeed ratio, and wherein a yarn having a straight shape resembling that of a ring-spun yarn can be made.

Figure 6A:
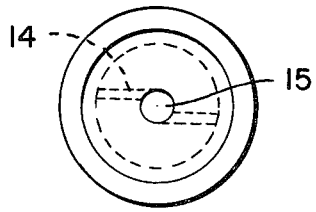
FIGS. 6A and 6B and FIGS. 7A, 7B, 7C and 7D are views showing other embodiments of the present invention.
Figure 6B:
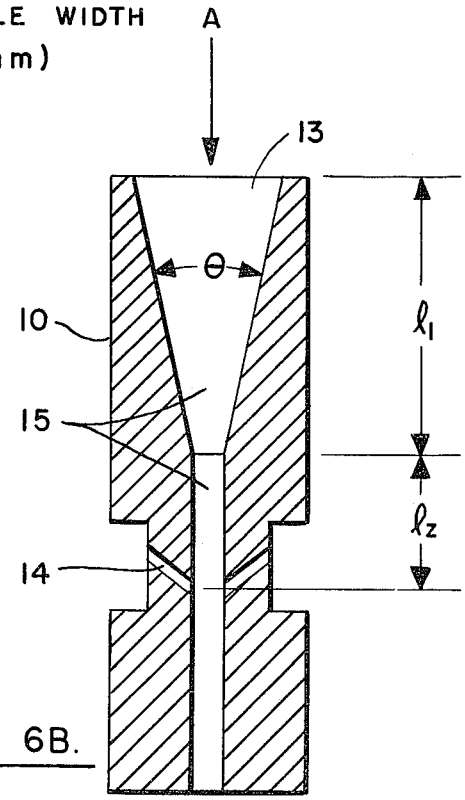
Figure 7A:
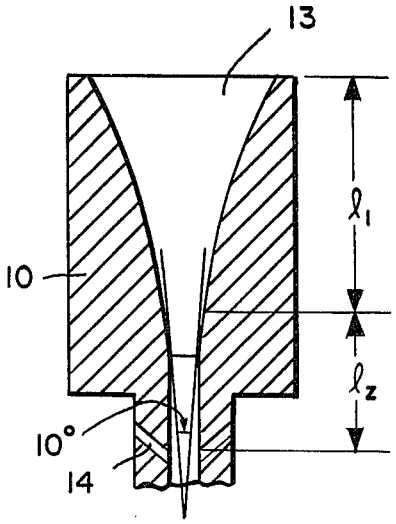
Figure 7B:
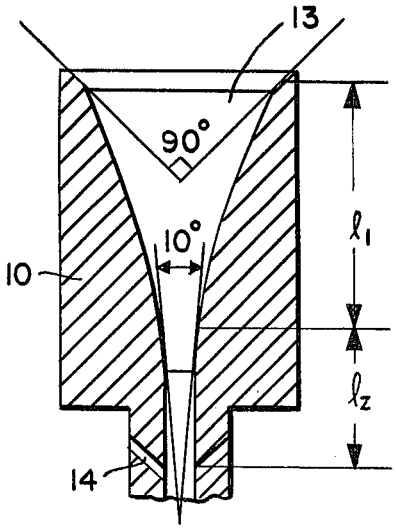
Figure 7C:
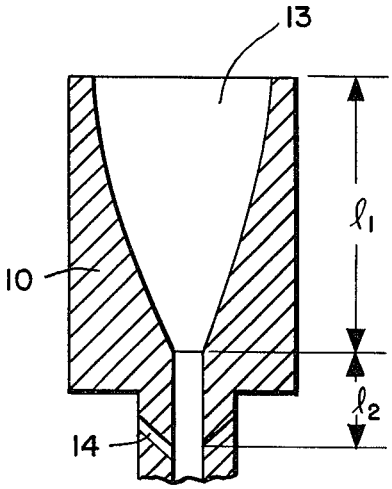
Figure 7D:
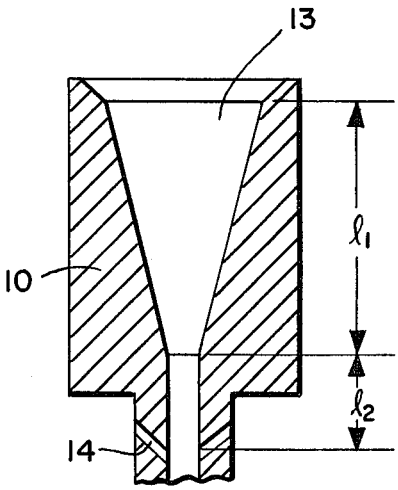

In the present invention, moreover, a nozzle may be used in which a taper angle $\theta$ from the nip point to the downstream portion of the pneumatic duct or the false twisting nozzle ranges from 10 degrees to 90 degrees, as shown in FIGS. 6 and 7. More specifically, if a taper forming portion 13 is within a range of 10 degrees to 90 degrees, the yarn has its ballooning shape prevented from being disturbed, but is stably vibrated, so that the peripheral fibers for wrapping are stably prepared. The nozzle may be constructed to satisfy the following relationships, where the taper length of the taper forming portion is designated by $l_1$ and the length from the taper terminating portion to fluid injection holes 14 is designated by $l_2$:

$$0.1 < l_2/l_1 < 0.5$$

Thus, the ballooning shape can also be stabilized. Incidentally, in FIGS. 6A and 6B and in FIGS. 7A, 7B, 7C and 7D, reference numerals 10 and 15 indicate a false twisting nozzle and the yarn passage of the twisting zone, respectively.

Figure 8:
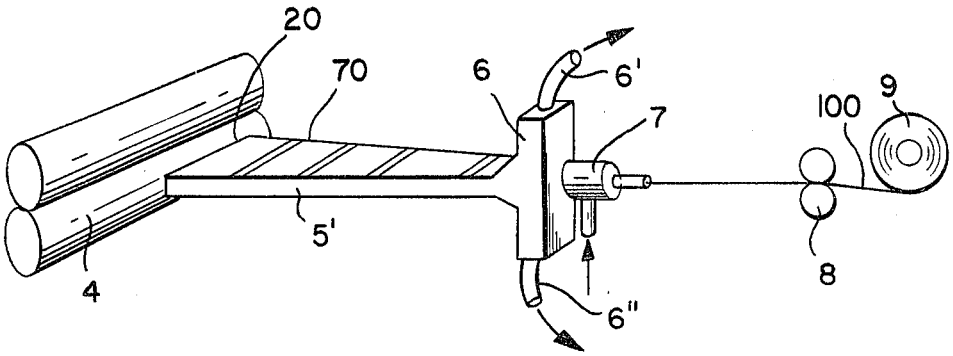
FIGS. 8, 9 and 10 are views showing still another embodiment of the present invention.
Figure 9:
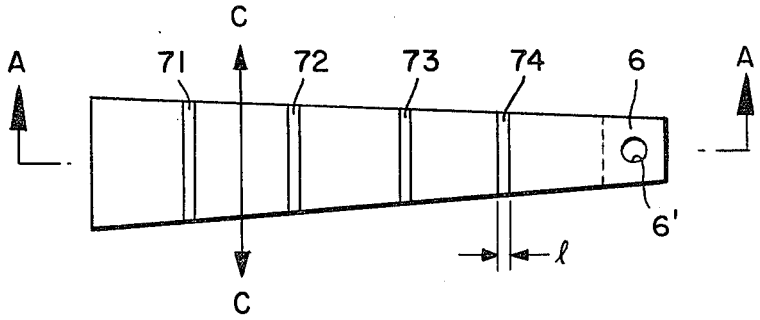
Figure 10:
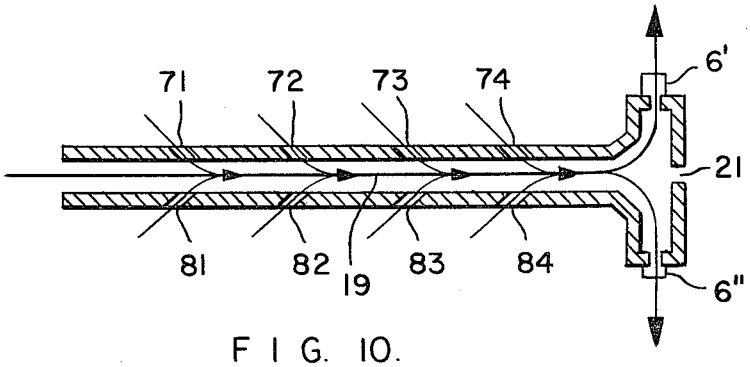

In the present invention, the bundle of fibers fed by the front drive rollers 4 may be introduced into the flattened pneumatic adaptor 5', transferred by the suction of the pneumatic duct 6, and twisted and detwisted by the false twisting nozzle 7 to make spun yarn 100, as shown in FIGS. 8, 9 and 10.

In the process under consideration, the flattened pneumatic adaptor 5' is formed with gas inlet ports 70, 71 to 74 and 81 to 84 so that it functions to arrange the suction flow to prepare the free end fibers stably without any disturbance.

Reference numerals 20, 6' and 6'' and 21 indicate the inlet of the pneumatic adaptor 5', suction tubes, and a hole for providing communication with the false twisting nozzle respectively.

In FIG. 9, the shape taken in the widthwise direction C—C is preferably rectangular. Moreover, the slit width l may be about 0.5 to 2 mm.

In FIG. 10, arrows indicate the directions of the air flows. Moreover, FIG. 10 is a sectional side elevation taken along line A—A of FIG. 9.

EXAMPLE 1

Mixed polyester/cotton slivers, which were composed of 65% polyester fibers of 1.3d×38 mm and 35% American cotton combed sliver and which had a thickness of 1.58 g/m, were spun into fasciated spun yarns of 1/76 Nm under the conditions below for fiber bundle widths of 5, 8, 10 and 12 mm. using a spinning frame having a roller drafting zone formed by a three-roller apron drafting unit, as shown in FIG. 1.

Drafting Conditions:

Draft ratio: 120;

Front Roller Speed: 100 m/min.;

Overfeed Ratio: 0.8%.

Figure 3A:
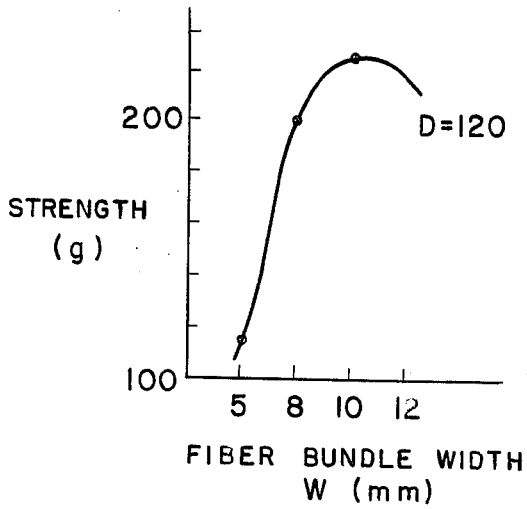
FIGS. 3(A) and 3(B), FIGS. 4(A) and 4(B), and FIG. 5 are graphs plotting the strength and the CV (coefficient of variation) values of the yarn strength against the fiber bundle width and illustrate the practical results of the present invention.
Figure 3B:
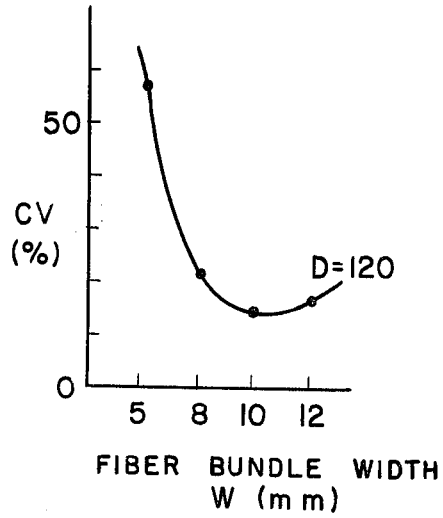

The fasciated spun yarns thus made had the strength and CV values of the strength illustrated in FIGS. 3(A) and 3(B). Thus, all of the yarns had stable strengths. In particular, the spun yarns having fiber bundle widths equal to or larger than 8 mm were satisfactory.

EXAMPLE 2

Three mixed polyester/cotton slivers, which were composed of 65% polyester fibers of 1.3d×38 mm and 35% American cotton carded sliver and which had thicknesses of 1.6 g/m, 3.2 g/m and 4.8 g/m, were spun into fasciated spun yarns of 1/34 Nm under the conditions below for fiber bundle widths of 8, 12, 16 and 20 mm using the same spinning frame as that of the Example 1:

Drafting Conditions:

Draft ratio:

53 (for slivers of 1.6 g/m);

106 (for slivers of 3.2 g/m);

159 (for slivers of 4.8 g/m);

Front Roller Speed: 100 m/min.;

Overfeed Ratio: 0.8%.

Figure 4A:
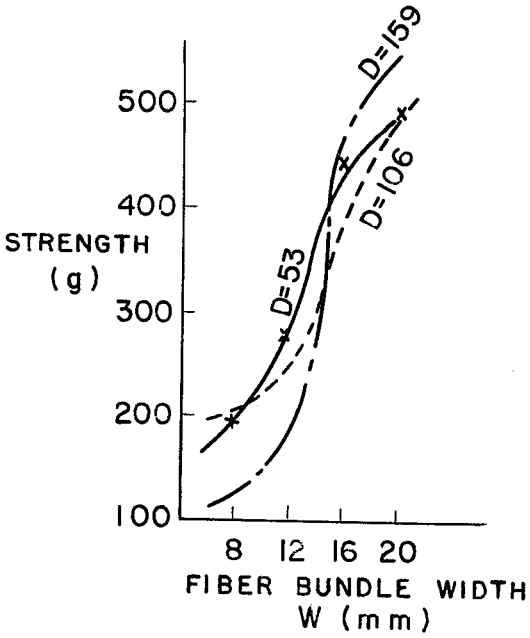
Figure 4B:
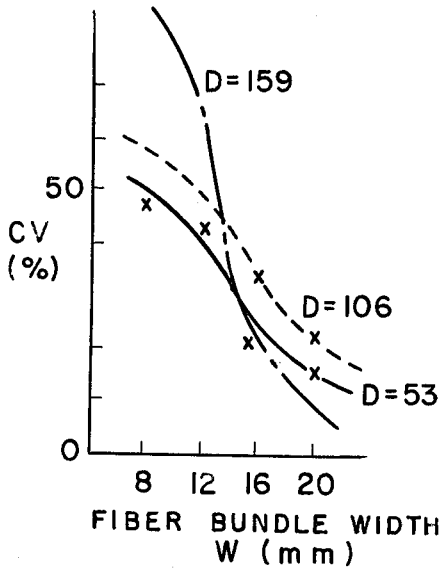

The fasciated spun yarns thus made had the strength and CV values of the strength illustrated in FIGS. 4(A) and 4(B). Thus, all of the yarns had stable strengths. In particular, the spun yarns having fiber bundle widths equal to or larger than 16 mm were satisfactory.

EXAMPLE 3

Two slivers, which were made of polyester fibers of 3d×102 mm and which had thicknesses 8.3 g/m and 16.6 g/m, were spun into fasciated spun yarns of 1/6 Nm under the conditions below for fiber bundle widths of 15, 25, 35 and 45 mm using the spinning frame having its roller drafting zone formed by the three-roller apron midway-omitted unit, as shown in FIG. 1:

Drafting Conditions:

Draft ratio:

50 (for slivers of 8.3 g/m);

100 (for slivvers of 16.6 g/m);

Front Roller Speed: 120 m/min.;

Overfeed Ratio: 1.0%.

Figure 5:
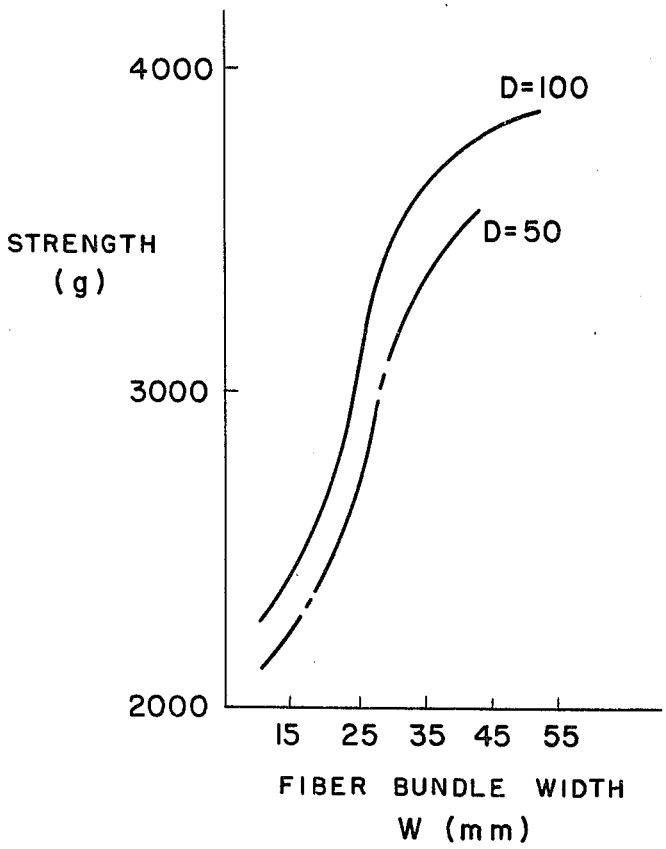

The fasciated spun yarns thus made had the strength illustrated in FIG. 5 with all of them having stable strength. Especially, the spun yarns having fiber bundle widths equal to or larger than 35 mm were satisfactory.

EXAMPLE 4

Using the fasciated spun yarn making process shown in FIG. 1B, short fibers of polyester (which had a single fiber fineness of 1.5 denier and an average fiber length of 110 mm) were spun at a spinning speed of 300 m/min. into fasciated spun yarns of 1/50 Nm. In this Example, the compression air pressure of the pneumatic false twisting nozzle 7 was 5.0 kg/cm$^2$, the overfeed ratio of the front rollers 4 to the delivery rollers 8 was 4.0%, and fiber bundle width was 12 mm, whereas the remaining conditions were the same as those of the Example 1. The nozzle used had the fundamental structure shown in FIG. 6B and had the values $\theta$ and $l_2/l_1$ varied, for each of the fasciated spun yarns made. The results are tabulated in Table 1:

TABLE 1

| | Yarn A (Comparative) | Yarn B (Present Invention) | Yarn C (Present Invention) | Yarn D (Comparative) | Yarn E (Comparative) | Yarn F (Comparative) | Yarn G (Comparative) |
|---|---|---|---|---|---|---|---|
| Shape $\theta$ (degrees) | 10 | 22 | 30 | 30 | 30 | 45 | 110 |
| of Nozzle $l_2/l_1$ | 0.08 | 0.24 | 0.44 | 3.08 | 3.2 | 0.7 | 0.9 |
| Spinning | 7.9 | 11.0 | 8.5 | 7.8 | 7.0 | 8.0 | 7.8 |

TABLE 1-continued

| | Yarn A (Comparative) | Yarn B (Present Invention) | Yarn C (Present Invention) | Yarn D (Comparative) | Yarn E (Comparative) | Yarn F (Comparative) | Yarn G (Comparative) |
|---|---|---|---|---|---|---|---|
| Tension | | | | | | | |
| Wrapping State of Fasciated Fibers* | Δ | ⊙ | O | Δ | Δ | Δ | Δ |
| Fluffed State** | X | ◎ | ◎ | Δ | Δ | Δ | X |

*number of portions of yarn without wrapping for more than 3 cm. in a 10 m length of yarn
◎: 0 portions
O: 1–9 portions
Δ: >10 portions
**observed fluffed state
◎: inconspicuous (good)
Δ: striking
X: unacceptable In Table 1, the spinning tension was measured just upstream of the delivery rollers 11 and took the higher values as a result of the spinning contraction under the identical spinning conditions as the ballooning shape is effectively formed so that fibers having a stronger fasciation were prepared. On the other hand, the yarn having an excellent wrapping state of fasciated fibers in a yarn in which the fasciated fibers are formed all over thereof, whereas the yarn having a deteriorated state is a yarn in which the fasciated fibers partially disappear.

The fluffed state refers to that of the yarn surface, and the more fluffed yarn is worse because neps are formed in subsequent steps accompanied by a drawing action as when in a rewinding operation.

In any of A-G, a fasciated spun yarn can be made. Of these, yarns B and C were prepared by the nozzle of the present invention which has nozzle configuration of $10° < \theta < 90°$ and $0.1 < l_2/l_1 < 0.5$. Yarns B and C are excellent in having a spinning tension higher by 0.6 to 0.5 g, a better spun state and less apparent fluff than A, D, E, F and G. On the other hand, yarns A, D, E, F and G having a lower spinning tension are not preferable because they have an inferior fasciated state and are more likely to fluff so that they may cause problems of clogging guides with neps or of degradation in the quality of the products produced therefrom.

Incidentally, the spun yarn-with the overfeed ratio of 6.2% is not preferred because it had a rough surface.

EXAMPLE 5

Double rovings having an average fiber length of 115 mm, fineness of 1.5 d and thickness of 0.5 g/m were drafted 49 times and spun by the process of FIGS. 8, 9 and 10 and under the same conditions as those of Example 4 using a suction air flow type transfer tube of the present invention, which had an inlet of 3×30 mm (i.e., height x width) and an outlet of 6×12 mm, as shown in FIGS. 1 to 3 thereby making a fasciated spun yarn of 1/95 Nm. In this Example the overfeed ratio was 3.5%; the fiber bundle width was 8 mm; the spinning speed was 100 m/min.; and the air pressure of the pneumatic twisting nozzle was 2.5 kg/cm$^2$.

For comparative purposes, a yarn of 1/95 Nm was spun under the same conditions as the aforementioned ones by the use of patent transfer apron bands, which is disclosed in U.S. Pat. No. 4,003,194, in place of the transfer tube.

Table 2 presents the comparative data of the quality and operability (e.g. end breakage) of the two yarns:

TABLE 2

| | Invention | Apron Bands |
|---|---|---|
| Yarn Count | 1/95.0 | 1/95.0 |
| Strength (g) | 32.3 | 32.5 |
| Elongation (%) | 15.9 | 16.2 |
| Fluff (No./m) | 14.8 | 15.1 |
| Uster U % | 12.8 | 12.7 |
| End Breakage (No./1000 sp:h) | 39 | 51 |

It is apparent from this Table, that the quality of the yarn prepared according to the process of the present invention is about comparable to the yarn prepared using the transfer apron band system in strength, elongation, the number of fluffs and spots measured as Uster U%. As to end breakage, the yarn of the present invention is far superior in spinning stability to that of the apron system because the end breakage of the apron system was 51 times/1000 sp.hr. due to the wrapping upon the aprons or the clogging of the nozzle whereas the end breakage of the present invention was 39 times/1000 sp.hr.

By the process thus far described, moreover, the mixed slivers, which were composed of 65%, polyester fibers having a fiber length of 38 mm and a single fiber fineness of 1.5 d and 35% cotton fibers, were similarly spun to make a satisfactory yarn without any problem. The roughness of the yarn surface is little, and the uniformity is excellent.

What we claim is:

1. A process for making a fasciated spun yarn, wherein a bundle of fibers, drafted in a drafting zone having a pair of back rollers, a pair of second rollers and a pair of front rollers, is twisted and detwisted by false twisting means while being overfed between the pair of front rollers and a pair of delivery rollers, characterized in that the width W (mm) of said bundle of fibers measured just upstream of the nip point of a pair of second rollers of said drafting zone and a yarn count N (Nm) of said spun yarn are set to satisfy the following relationships:

$$60/\sqrt{N} \leqq W \leqq 170\sqrt{N}. \text{ and}$$

in that the overfeed ratio is set to be equal to or lower than 5%.

2. A process as claimed in claim 1, characterized in that said overfeed ratio is set to be equal to or lower than 3%.

3. A process as claimed in claim 1, characterized in that said false twisting means has a nozzle portion having a tapered angle $\theta$ ranging from 10 degrees to 90 degrees.

4. A process as claimed in claim 3, characterized in that said nozzle portion of said false twisting means has a taper forming portion, a taper terminationg portion and fluid injection holes, wherein the taper forming portion has a taper length, designated $l_1$, and the length from the taper terminating portion to the fluid injection holes, designated $l_2$, satisfy the relationship $$0.1 < l_2/l_1 < 0.5.$$

5. A process as claimed in claim 1, characterized in that the bundle of fibers fed by the front rollers may be introduced into a flattened pneumatic duct, and twisted and detwisted by the false twisting means.

6. A process as claimed in claim 5, characterized in that the flattened pneumatic duct is formed with gas inlet ports.

* * * * *